US009227334B2

(12) United States Patent
Colombatto

(10) Patent No.: US 9,227,334 B2
(45) Date of Patent: Jan. 5, 2016

(54) MULTIPLE ROTARY KNIFE FOR LONGITUDINAL SPLITTING OF WEBS

(71) Applicant: TURMOND S.p.A., Val della Torre (Turin) (IT)

(72) Inventor: Alessandro Colombatto, Turin (IT)

(73) Assignee: TURMOND S.P.A., Via Della Torre (IT)

( * ) Notice: Subject to any disclaimer, the term of this patent is extended or adjusted under 35 U.S.C. 154(b) by 131 days.

(21) Appl. No.: 13/864,948

(22) Filed: Apr. 17, 2013

(65) Prior Publication Data

US 2013/0291700 A1 Nov. 7, 2013

(30) Foreign Application Priority Data

Apr. 18, 2012 (IT) ..... TO2012A0346

(51) Int. Cl.
*B26D 1/143* (2006.01)
*B26D 1/00* (2006.01)
*B26D 1/24* (2006.01)

(52) U.S. Cl.
CPC ..... *B26D 1/1435* (2013.01); *B26D 1/0006* (2013.01); *B26D 1/245* (2013.01); *B26D 2001/006* (2013.01); *B26D 2001/0033* (2013.01); *Y10T 83/9374* (2015.04)

(58) Field of Classification Search
CPC ..... B26D 1/0006; B26D 1/1435; B26D 2001/0033; B26D 1/245; B26D 2001/006; Y10T 83/9374
USPC ..... 83/402, 676, 481, 665, 666, 699, 838, 83/698, 663, 835, 647.5, 829, 169, 646, 83/698.41; 125/15, 13.01, 16.01, 4.22, 11, 125/22; 403/344; 29/428; 156/60, 510, 553, 156/582
See application file for complete search history.

(56) References Cited

U.S. PATENT DOCUMENTS

| | | | | | |
|---|---|---|---|---|---|
| 1,958,694 | A * | 5/1934 | Chandler | 83/660 |
| 3,240,243 | A * | 3/1966 | Golick | 83/168 |
| 3,908,499 | A * | 9/1975 | Reed | 83/665 |
| 4,102,231 | A * | 7/1978 | Jagers | 83/854 |
| 5,027,684 | A * | 7/1991 | Neukam | 83/481 |
| 5,974,922 | A * | 11/1999 | Camp et al. | 83/37 |
| 6,463,920 | B1 * | 10/2002 | Kondo et al. | 125/15 |
| 7,444,911 | B2 * | 11/2008 | Sanda et al. | 83/425.2 |
| 7,866,242 | B1 * | 1/2011 | Harris | 83/698.41 |
| 2007/0163416 | A1 * | 7/2007 | Burgess | 83/853 |
| 2011/0041308 | A1 * | 2/2011 | Swanson et al. | 29/428 |

FOREIGN PATENT DOCUMENTS

| | | | |
|---|---|---|---|
| DE | 202 13 692 | U1 | 1/2002 |
| DE | 10 2009 011330 | A1 | 9/2010 |
| EP | 0238657 | B1 | 3/1992 |

OTHER PUBLICATIONS

Italian Search Report for corresponding priority application No. TO2012A000346 filed on Apr. 18, 2012, completed on Dec. 6, 2012.

* cited by examiner

*Primary Examiner* — Ghassem Alie
(74) *Attorney, Agent, or Firm* — Heslin Rothenberg Farley Mesiti, PC; Victor Cardona

(57) ABSTRACT

A multiple rotary knife for longitudinal splitting of webs, includes a generally cylindrical annular body bearing a plurality of circumferential blades spaced apart. The circumferential blades are formed by continuous hard-metal rings mechanically fixed axially to the annular body.

14 Claims, 4 Drawing Sheets

MULTIPLE ROTARY KNIFE FOR LONGITUDINAL SPLITTING OF WEBS

CROSS-REFERENCE TO RELATED APPLICATIONS

This application claims priority to Italian Patent Application No. TO2012A000346 filed on Apr. 18, 2012, the entire disclosure of which is incorporated herein by reference.

FIELD OF THE INVENTION

The present invention relates in general to splitting of continuous webs into longitudinal strips, with particular, albeit non-exclusive, reference to the production of adhesive tape, medical plasters and the like, with the use of equipment that employs a pair of multiple rotary knives between which the longitudinal web to be cut is fed in a direction perpendicular to the axes of rotation of the rotary knives.

More in particular, the invention regards the aforesaid multiple rotary knives, and even more in particular to the bottom knife that operates like a multiple counterblade with the top knife of cutting equipment of the above sort.

PRIOR ART

The multiple rotary knife that forms the subject of the invention conventionally consists of a generally cylindrical annular body bearing a plurality of circumferential blades spaced apart, in the way for example described and illustrated in the document No. EP-0238657B1, where the circumferential blades are formed by the edges of the walls of grooves formed integrally in the body of the knife, which is typically made of steel.

This solution, albeit relatively inexpensive, entails in use the drawback of fast wear of the cutting edges and the consequent need for sharpening, which entails the need to remove and replace the multiple knife frequently, with the consequent pauses in operation of the cutting machine that derive therefrom.

This drawback is particularly critical in the case where the web undergoing splitting is of a high-friction material, for example a fibrous material or a material with adhesive surface. In the latter case, in addition to frequent sharpening of the cutting edges of the knife, it is also necessary to proceed to their periodic cleaning with solvents to remove the adhesive that has deposited thereon.

In an attempt to overcome these drawbacks, it has been proposed in the document No. DE-20213692U1 to make the blades of the multiple rotary knife of hard metal. According to this document, the grooved cylindrical body of the knife is formed by two semi-cylindrical parts, and applied within the semi-circular groove of each semi-cylindrical part is a half-ring made of hard material, the edge of which defines a respective cutting blade of the multiple knife.

If on the one hand this solution enables an appreciable increase in the service life of the knife, also reducing the need for periodic cleaning, it entails, however, a considerable and costly complication in the production of the knife in relation both to fixing of the hard-metal half-rings, which must be welded or bonded to the half-parts of the body, and to assemblage of said half-parts.

SUMMARY OF THE INVENTION

The object of the invention is to overcome the aforesaid drawbacks, and more in particular to provide a multiple rotary knife of the type defined above that will combine a considerably increased service life with ease and simplicity of production.

With a view to achieving the above object, the subject of the invention is a multiple rotary knife of the type defined at the start, the essential characteristic of which lies in that the circumferential blades of the knife are formed by continuous hard-metal rings mechanically fixed axially to the annular body.

In a first embodiment of the invention, currently considered preferred, the body of the multiple knife is constituted by a hub having at one end an annular flange and the opposite end an external thread, and the hard-metal rings are axially packed on the hub between the end flange and an internally threaded clamping ring, screwed on the external thread. Axially set between each hard-metal ring and the contiguous hard-metal ring is an annular spacer, the outer diameter of which is smaller than the outer diameter of the hard-metal rings.

In order to guarantee a more precise and stable axial packing, the clamping ring conveniently has a ring of axial threaded holes, screwed into which are axial-thrust threaded members of the hard-metal rings and of the corresponding annular spacers.

In a second embodiment of the invention, the body of the multiple knife is formed, instead of by a hub, by a pair of end rings and by a plurality of intermediate annular spacers, which all have the outer diameter smaller than the outer diameter of the hard-metal rings, which are set between the end rings and the annular spacers and are packed therewith via a ring of axial screws inserted through corresponding axial through holes of the end rings, of the hard-metal rings, and of the annular spacers.

In both embodiments, each hard-metal ring has at least one oblique cutting flank, which is inclined by an angle typically of about 3° with respect to the longitudinal axis of the knife. Preferably, the cutting flank or each cutting flank connects up to the periphery of the hard-metal ring through an initial stretch orthogonal to the longitudinal axis of the knife.

BRIEF DESCRIPTION OF THE DRAWINGS

The invention will now be described in detail with reference to the annexed drawings, which are provided purely by way of non-limiting example and in which.

DETAILED DESCRIPTION OF THE INVENTION

Figure 2:
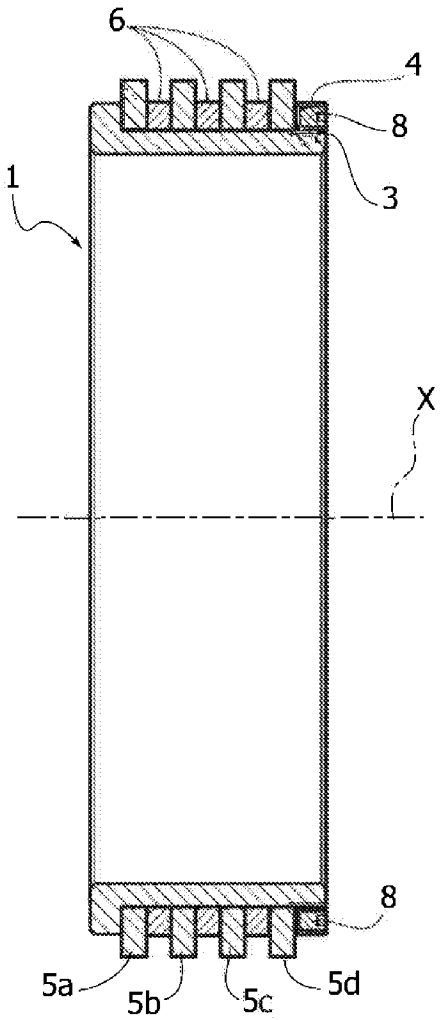
FIG. 2 is an axial cross-sectional view of FIG. 1.
Figure 1:
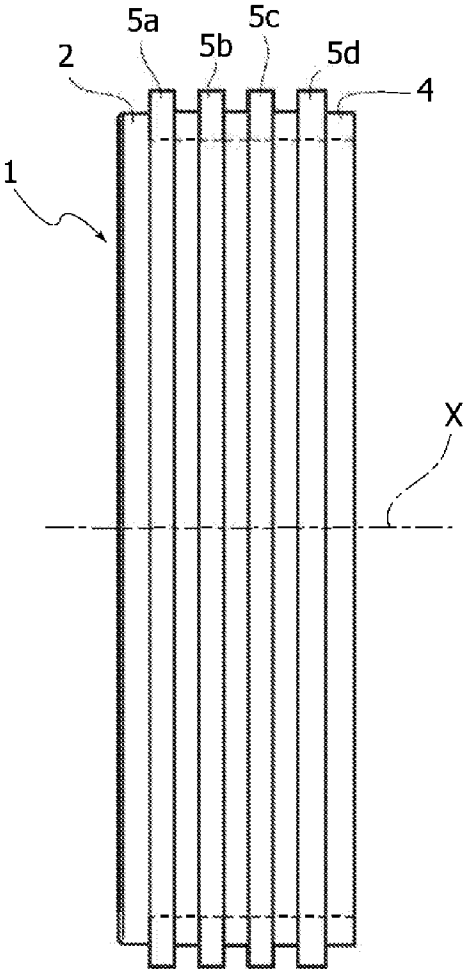
FIG. 1 is a view in side elevation of a multiple rotary knife according to a first embodiment of the invention.
Figure 3:
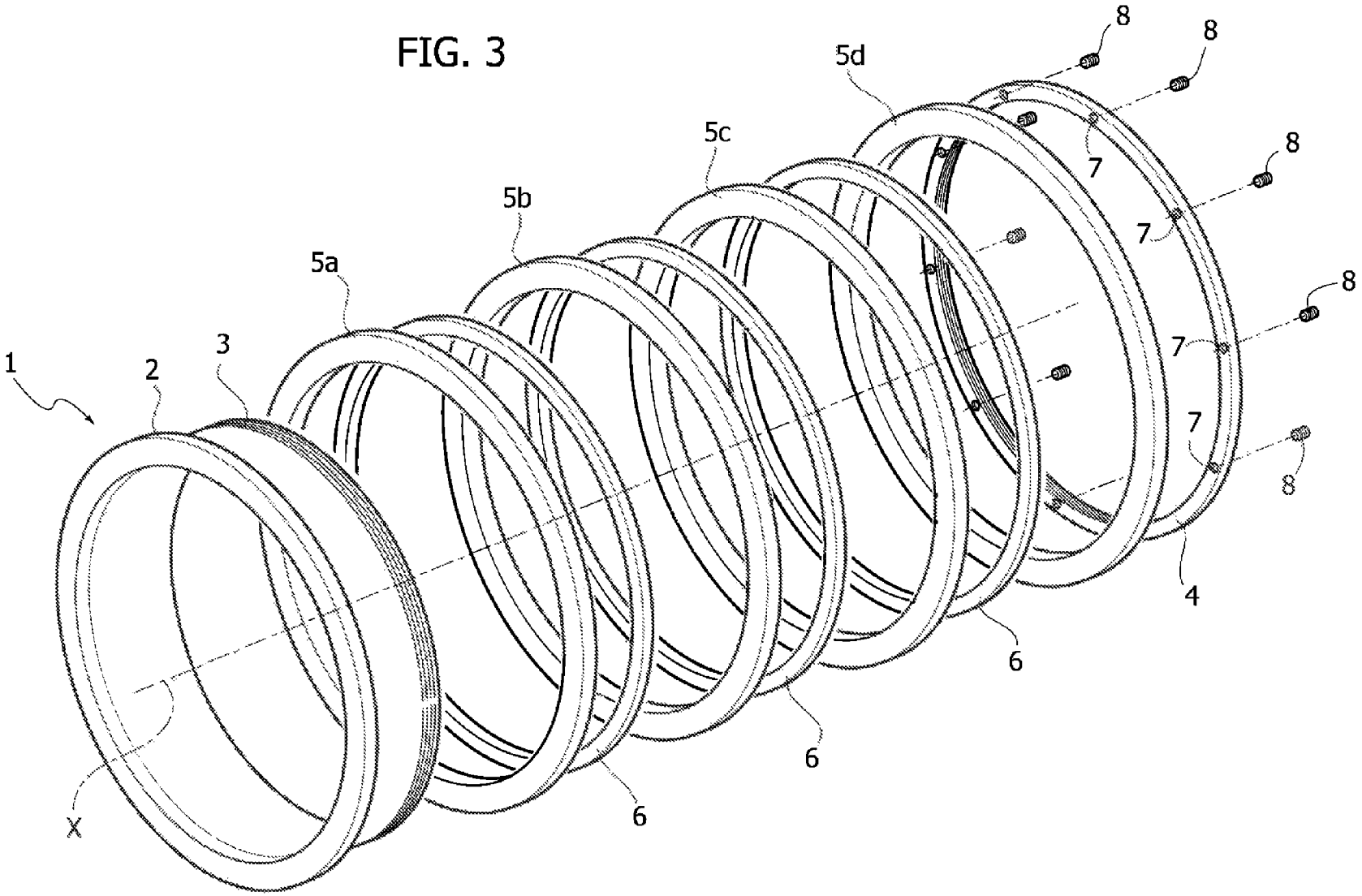
FIG. 3 is an exploded perspective view of FIG. 1.

Illustrated in FIGS. 1 to 3 is a first embodiment of the multiple rotary knife according to the invention that is currently considered preferred.

In a generally conventional way, the multiple knife is designed to be fixed on a rotating shaft of a machine for longitudinal splitting of webs so as to constitute a counterblade assembly, for example a bottom assembly, designed to co-operate with a top-blade assembly with reference to the path of advance of the web to be cut.

According to the preferred embodiment described herein, the multiple rotary knife comprises an annular body or hub 1 of a generally cylindrical shape and normally made of steel, having at one end an annular flange 2 and at the opposite end an external threaded 3, on which an internally threaded clamping ring 4 is screwed.

Between the flange 2 and the clamping ring 4 the hub 1 bears a plurality (in the example illustrated four in number) of circumferential blades 5*a*, 5*b*, 5*c* and 5*d* spaced apart, axially packed with the interposition of a set (in the example illustrated, three in number) of annular spacers 6.

The circumferential blades 5*a*-5*d* are constituted by uninterrupted rings made of hard metal (tungsten carbide) having an outer diameter greater than that of the end flange 2, of the clamping ring 4, and of the annular spacers 6 and defining the cutting edges of the multiple knife.

Axial packing of the circumferential blades 5*a*-5*d* and of the annular spacers 6 on the hub 1 is obtained as a result of screwing of the clamping ring 4 on the thread 3 of the hub 1 and of the consequent axial thrust against the end flange 2. To render said axial packing, and hence the mechanical retention of the circumferential blades 5*a*-5*d* on the hub 1, even more stable and precise the clamping ring 4 has a ring of axial threaded holes 7 within which threaded grubscrews 8 engage, tightening of which produces an additional axial thrust of the pack against the end flange 2.

Figure 5:
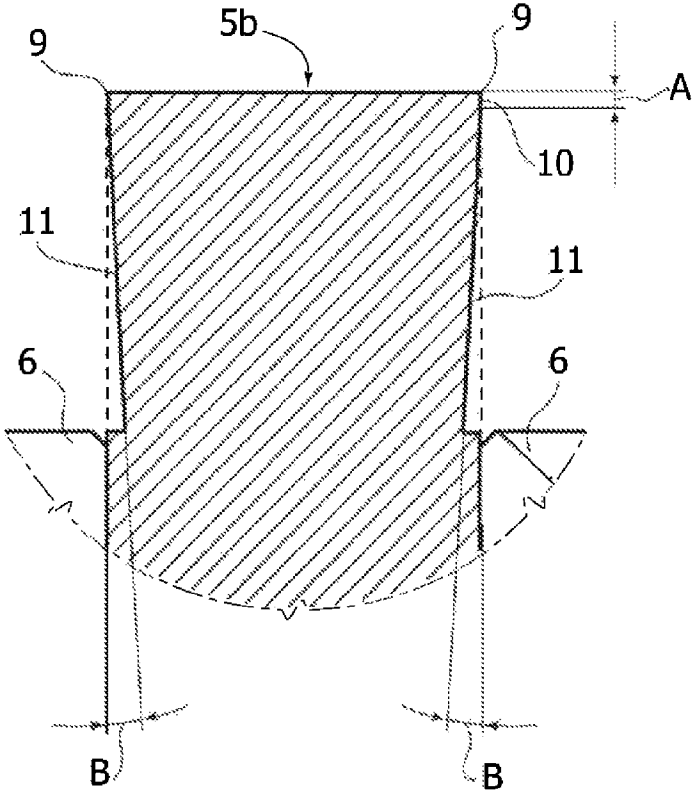
FIGS. 4 and 5 show at a larger scale two details of FIG. 2.
Figure 4:
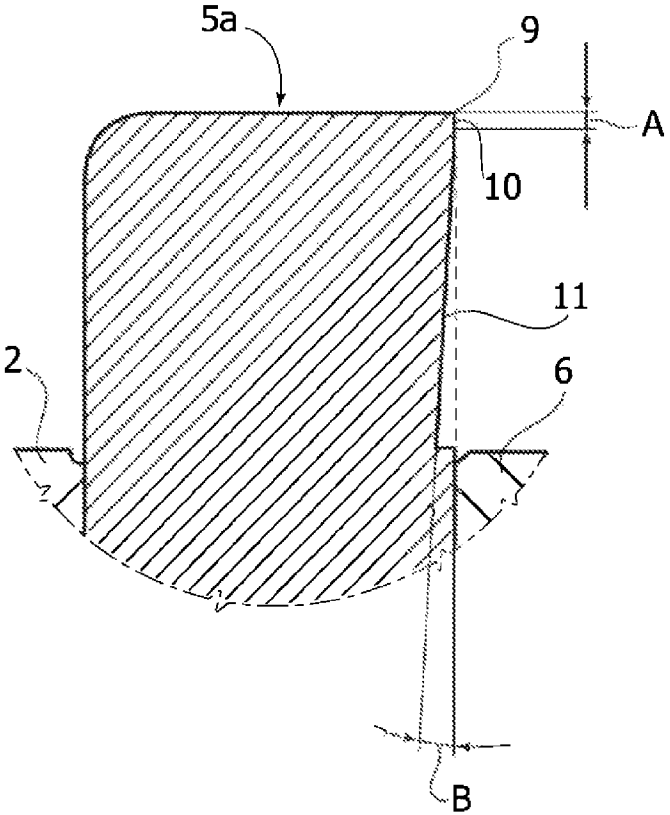

As has been said, the hard-metal rings 5*a*-5*d* define at the respective external annular edges the cutting edges of the multiple knife, in the case of the rings 5*a* and 5*d*, a single cutting edge corresponding to the axially internal edge, and in the case of the intermediate rings 5*b* and 5*c* a pair of cutting edges corresponding to both of the edges. FIGS. 4 and 5 show in detail the arrangement of the cutting edges, referred, respectively, to the ring 5*a* and to the ring 5*b*. In the first case, the single cutting edge, designated by 9, has an initial stretch 10, having for example a radial extension A of about 0.1-0.3 mm, which is orthogonal to the longitudinal axis of the knife designated by X in FIGS. 1 and 2. The initial stretch 10 is followed by a stretch 11 that is inclined with respect to the longitudinal axis X itself by an angle B comprised between 1° and 10°, for example of about 3°.

The configuration of the circumferential blade 5*b* represented in FIG. 5 is identical to the one described above for both of the opposite cutting edges 9.

Figure 7:
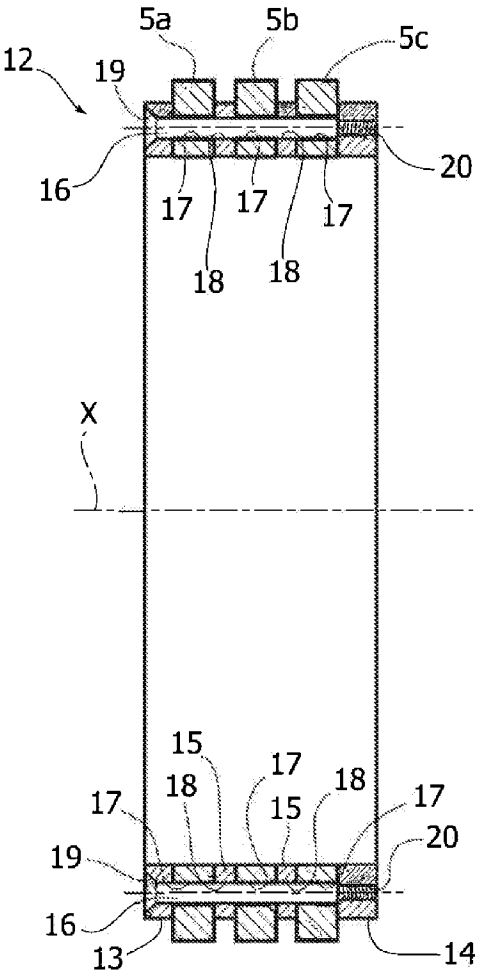
FIG. 7 is an axial cross-sectional view of FIG. 6.
Figure 6:
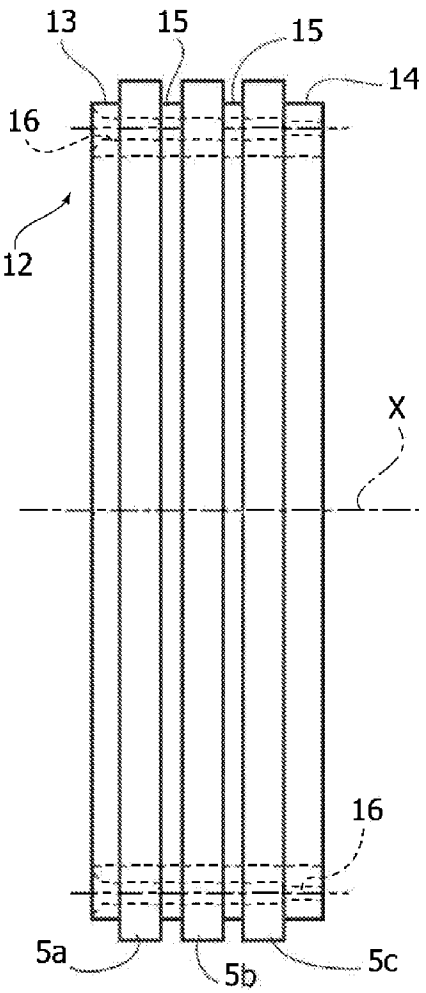
FIG. 6 is a view similar to that of FIG. 1 showing a second embodiment of the multiple rotary knife according to the invention.

The second embodiment illustrated in FIGS. 6 and 7 differs from the solution described previously in that the body of the multiple knife bearing the circumferential blades of hard metal is constituted, instead of by the hub described previously, by a set of annular elements 12 including a first end ring 13, a second end ring 14, and intermediate annular spacers 15. The hard-metal rings, in this case three in number 5*a*, 5*b* and 5*c*, are set between the end rings 13, 14 and the intermediate annular spacers 15 and are axially packed with these via a ring of axial screws 16 that traverse respective through holes 17 of the hard-metal rings 5*a*, 5*b* and 5*c* and holes 18 of the annular spacers 15, and the heads of which engage within respective seats 19 in the end ring 13. The opposite ends of the screws 16 are threaded and screwed into respective threaded holes 20 of the end ring 14.

Figure 8:
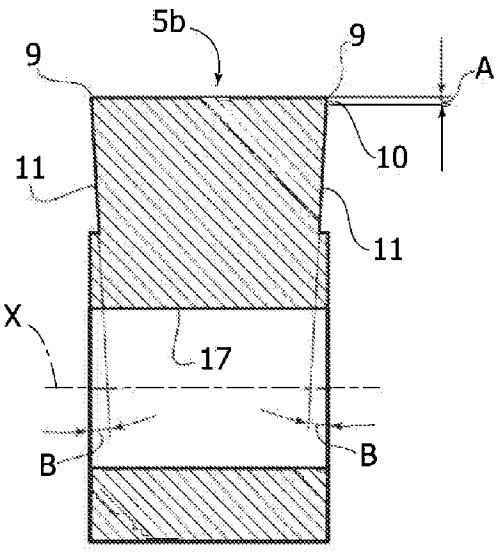
FIG. 8 shows at a larger scale a detail of FIG. 7.

The conformation of the cutting edges of the hard-metal rings 5*a*, 5*b* and 5*c* is altogether identical to the one described with reference to the first embodiment. FIG. 8 shows the detail of the hard-metal ring 5*b*, with the corresponding cutting edges 9, the stretches 10 orthogonal to the longitudinal axis X of the knife, and the inclined stretches 11.

In both embodiments, the multiple knife according to the invention has, as compared to conventional knives, a considerably increased service life together with the elimination of the need to proceed to periodic cleaning of its knives, also in the case where the material of the webs subjected to the splitting operation presents adhesive surfaces. Moreover, the quality and precision of the splitting operation performed by the multiple knife according to the invention are improved also in the case where the materials of the webs to be split are fibrous, and the further advantage is achieved of a spontaneous sharpening of the blades of the other multiple knife (normally the top one, made of steel) with which the knife according to the invention co-operates in use.

Of course, the details of construction and the embodiments may vary widely with respect to what is described and illustrated herein, without thereby departing from the scope of the present invention as defined in the ensuing claims.

The invention claimed is:

1. A multiple rotary knife for longitudinal splitting of webs, comprising:

a generally cylindrical annular body bearing a plurality of circumferential blades spaced apart, wherein said circumferential blades are formed by continuous hard-metal rings mechanically fixed axially to said annular body;

wherein each hard-metal ring has at least one cutting flank, said at least one cutting flank having an oblique portion inclined by an angle comprising between 1° and 10° relative to a longitudinal axis of the knife;

an outermost radial surface of said ring being parallel to the longitudinal axis of the knife, said oblique portion being oblique relative to said outermost surface;

said at least one cutting flank having an initial stretch orthogonal to the longitudinal axis of the knife and said initial stretch having a longitudinal dimension shorter than said oblique portion of said at least one cutting flank, said initial stretch being immediately adjacent to said outermost radial surface of said hard-metal ring opposite said annular body;

said initial stretch perpendicular to said outermost surface;

said oblique portion extending from said initial stretch obliquely relative to said initial stretch.

2. The multiple knife according to claim 1, wherein said body comprises a hub having at one end an annular flange and at the opposite end and an external thread, and said hard-metal rings are axially packed on said hub between said end flange an internally threaded clamping ring screwed on said external thread; there being axially set between each hard-metal ring and the contiguous hard-metal ring an annular spacer, the outer diameter of which is smaller than the outer diameter of the hard-metal rings.

3. The multiple knife according to claim 2, wherein each hard-metal ring has at least one oblique cutting flank.

4. The multiple knife according to claim 2, wherein the hard-metal rings are uninterrupted.

5. The multiple knife according to claim 2, wherein said clamping ring has a ring of axial threaded through holes, screwed into which are axial-thrust threaded members that press said hard-metal rings and said annular spacers towards said end flange.

6. The multiple knife according to claim 5, wherein each hard-metal ring has at least one oblique cutting flank.

7. The multiple knife according to claim 5, wherein the hard-metal rings are uninterrupted.

8. The multiple knife according to claim 1, wherein said annular body comprises a pair of end rings and by a plurality of intermediate annular spacers, said end rings and said annular spacers having an outer diameter smaller than the outer diameter of the hard-metal rings; said hard-metal rings being set between said end rings and said intermediate annular spacers and being axially packed therewith via a ring of axial screws inserted through corresponding axial through holes of said end rings, of said intermediate annular spacers (15), and of said hard-metal rings.

9. The multiple knife according to claim 8, wherein each hard-metal ring has at least one oblique cutting flank.

10. The multiple knife according to claim 8, wherein the hard-metal rings are uninterrupted.

11. The multiple knife according claim 1, wherein the hard-metal rings are uninterrupted.

12. The Knife of claim 1 wherein at least one oblique portion is bounded on an end opposite said initial stretch by a returning portion connecting said cutting flank to a second portion of said ring parallel to said initial stretch.

13. The Knife of claim 1 wherein said at least one cutting flank comprises a second oblique portion on an opposite side of said ring, said oblique portion and said second oblique portion tapering said ring toward each other.

14. The Knife of claim 1 wherein said initial stretch has a longitudinal dimension in a range between 0.1 to 0.3 mm.

* * * * *